United States Patent [19]

Molitor

[11] Patent Number: 4,557,214

[45] Date of Patent: Dec. 10, 1985

[54] ROPE-HOLDING BOAT HOOK

[76] Inventor: Jerome A. Molitor, 13423 Land O Woods, Creve Coeur, Mo. 63141

[21] Appl. No.: 642,694

[22] Filed: Aug. 20, 1984

Related U.S. Application Data

[63] Continuation of Ser. No. 419,959, Sep. 20, 1982, abandoned.

[51] Int. Cl.[4] ..... B63B 21/54

[52] U.S. Cl. ..... 114/221 R; 294/19.1

[58] Field of Search ..... 114/221 R, 230; 411/400; 294/19.1

[56] References Cited

U.S. PATENT DOCUMENTS

| | | | |
|---|---|---|---|
| 842,933 | 2/1907 | Bement | 411/400 |
| 2,811,127 | 10/1957 | Palsson | 114/221 |
| 3,431,568 | 3/1969 | Brown | 114/230 |
| 3,828,716 | 8/1974 | Bernardi | 114/221 R |
| 3,861,346 | 1/1975 | Pina | 114/221 R |
| 3,878,808 | 4/1975 | Mock | 114/230 |
| 3,918,385 | 11/1975 | Wallace | 114/230 |
| 3,993,013 | 11/1976 | Nunziato | 114/221 R |
| 4,261,280 | 4/1981 | Collic, Sr. | 114/221 R |

*Primary Examiner*—Sherman D. Basinger

*Attorney, Agent, or Firm*—Polster, Polster and Lucchesi

[57] ABSTRACT

Collars are secured to a boat hook at spaced points along the length of the forward portion of that boat hook; and each of those collars has a rope-holding member which has a shank and a bent end. That boat hook will be rotated about its axis to dispose those rope-holding members in position to support two spaced parts of a loop which is adjacent one end of a rope; and then those two spaced parts of that loop will be draped over those rope-holding members. An elongated part of that loop will depend downwardly below the level of the forward portion of the boat hook; and movement of that forward portion in a given direction will move that downwardly-depending elongated part of that loop into engagement with one side of a piling or other mooring device, continued movement of that forward portion of that boat hook in that given direction will move the two spaced parts of that loop over and beyond the other side of that piling or other mooring device, and rotation of that boat hook about its axis will move the bent ends of the rope-holding elements downwardly until they release the two spaced part of that loop and thereby permit those two spaced part of that loop to respond to gravity to fall down on the other side of that piling or other mooring device.

5 Claims, 4 Drawing Figures

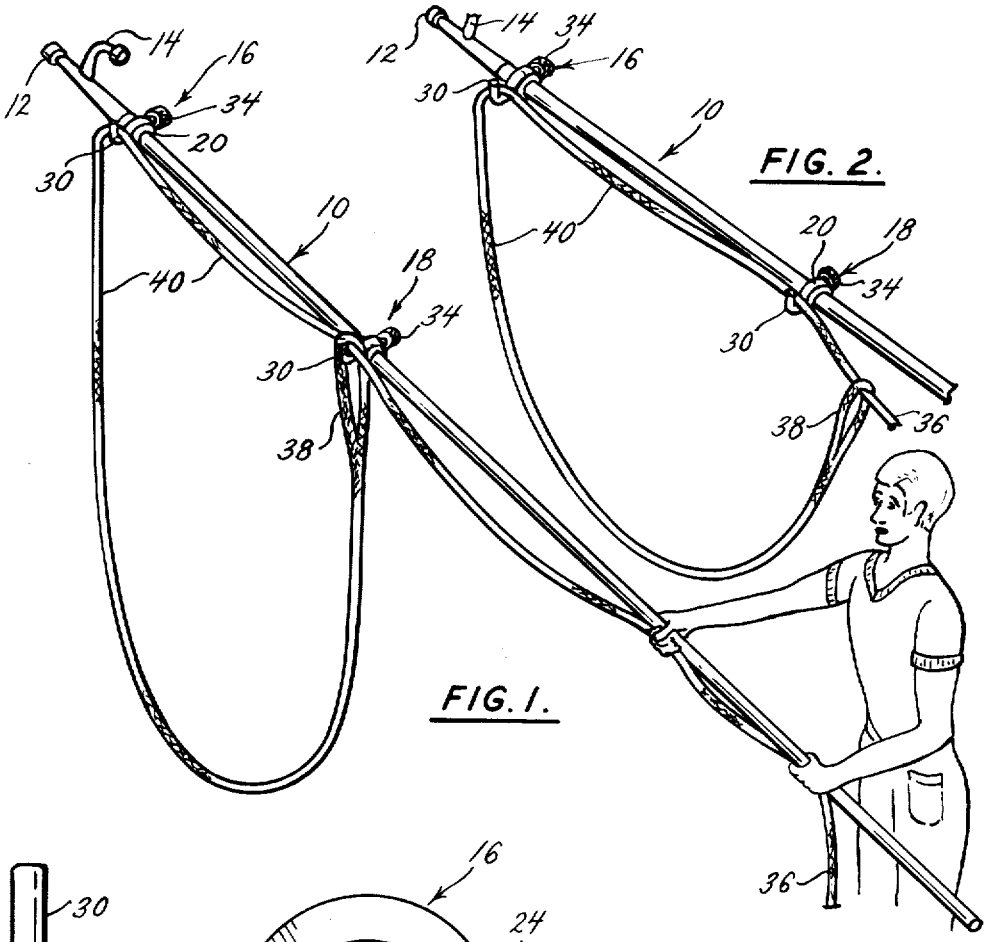
FIG. 2.
FIG. 1.
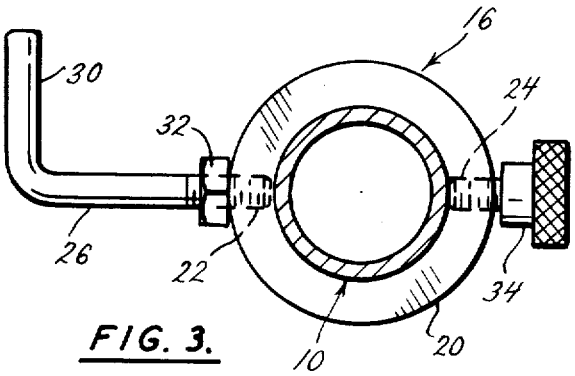
FIG. 3.
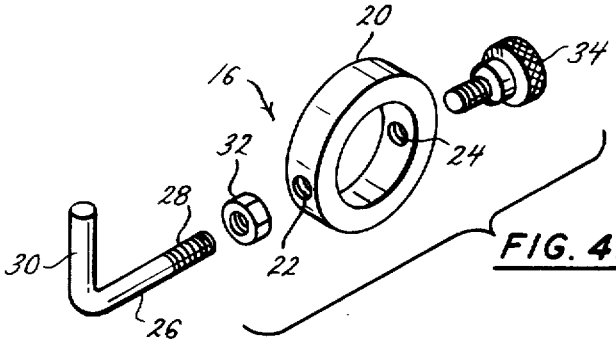
FIG. 4.

ROPE-HOLDING BOAT HOOK

This is a continuation of co-pending application Ser. No. 419,959 filed on 9/20/82 now abandoned.

BACKGROUND OF THE INVENTION

1. Field of the Invention

When a boat is to be moored, it is customary to place a loop, adjacent one end of a rope, over a piling or other mooring device. In many instances, a crew member positions himself or herself close to the bow of the boat, and then either reaches beyond the side of the boat to drape that loop over that piling or other mooring device, or attempts to throw that loop over that piling or other mooring device. Reaching beyond the side of the boat can be both dangerous and uncomfortable; and the throwing of a loop can, unless the crew member is skillful in throwing ropes, involve a good deal of time and frustration.

2. Description of the Prior Art

A number of devices have been proposed to simplify the telescoping of a loop, adjacent one end of a rope, over a piling or other mooring device. Some of those devices have been specially-designed boat hooks; and other of those devices have been boat hooks with rope-holding attachments. However, none of those devices has met wide-spread acceptance.

SUMMARY OF THE INVENTION

A boat hook has a rope-holding member adjacent the forward end thereof and has a second rope-holding member intermediate the first rope-holding member and the rear of the boat hook. The boat hook is rotatable about its axis to enable two spaced parts of a loop, which is adjacent one end of a rope, to be draped around those rope-holding members so an intervening part of that loop can depend downwardly below the level of the boat hook. The forward portion of the boat hook can be moved in a given direction to move the downwardly-depending part of the loop into engagement with one side of a piling or other mooring device, continued movement of that forward portion of that boat hook in that given direction will move the two spaced parts of that loop over and beyond the other side of that piling or other mooring device, and then rotation of that boat hook about its axis will move the rope-holding elements downwardly until they release the two spaced parts of that loop and thereby permit those two spaced parts of that loop to respond to gravity to fall down on the other side of that piling or other mooring device.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a perspective view of a boak hook which is being used to support a loop in the end of a rope, FIG. 2 is a perspective view of part of the boat hook of FIG. 1 and of part of a larger loop which is being supported by that boat hook, FIG. 3 is a sectional view, on a larger scale, through the boat hook of FIG. 1 and it shows one of the rope-supporting members of that boat hook, and FIG. 4 is an exploded view, on a scale intermediate those of FIGS. 1 and 3, of the rope-supporting member of FIG. 3.

DETAILED DESCRIPTION OF PREFERRED EMBODIMENT

Referring to the drawing in detail, the numeral 10 generally denotes a boat hook of standard and usual design which is equipped with a fending tip 12 and a hook portion 14 which is adjacent that tip. As indicated particularly by FIG. 3, that boat hook is tubular in construction, but, where desired, it could be made solid. The design, size and material used in making the boat hook 10 are not, per se, parts of the present invention; and any standard and usual boat hook could be used.

The numeral 16 denotes a rope-supporting member which is mounted on the forward portion of the boat hook 10, and the numeral 18 denotes a similar rope-supporting member which is mounted on that boat hook at a point which is intermediate the rope-supporting member 16 and the rear end of that boat hook. The preferred form of those rope-supporting members is shown by FIGS. 3 and 4; and it includes a collar 20 that is dimensioned to telescope readily over the rear end of the boat hook 10. A threaded socket 22 extends radially inwardly from one portion of the periphery of that collar, and a threaded opening 24 extends radially inwardly from a circumferentially-shaped portion of that periphery. Although that recess and opening are shown on the same diameter, they could be disposed at various angles relative to each other. The numeral 26 denotes a straight shank which has a threaded inner end 28 and a bent outer end 30. That threaded inner end is dimensioned to extend into, and to be held by, the threaded recess 22. A nut 32 is dimensioned to be threaded onto the threaded end 28 and to serve as a lock nut. The numeral 34 denotes a knurled locking bolt which has a threaded inner end that is held by the threaded opening 24. To minimize the cost of machining the collar 16, the recess 22 can be an opening which extends through to the inner periphery of that collar and is coaxial with the opening 24.

The rope-supporting members 16 and 18 can be set at desired points along the length of the boat hook 10. However, the rope-supporting member 16 preferably is close to the forward end of the boat hook 10 but is spaced far enough rearwardly from the hook portion 14 to enable that hook portion to perform its intended purpose and function. The rope-supporting member 18 is displaced far enough rearwardly from the rope-supporting member 16 to enable a desirably-large loop to be held by those rope-supporting members.

The numeral 36 denotes a rope of the type that is customarily used to a moor a small boat. A small loop 38 is formed in one end of that rope, and the other end of that rope is passed through that small loop to define a large loop 40. The shank 26 of the rope-supporting member 18 is long enough to directly support the small loop 38 plus the portion of rope 36 which extends through that small loop. As a result, the rope-supporting members 16 and 18 can be used to directly support a large loop 40 with a fixed width. If desired, however, the small loop 38 could be disposed rearwardly of the rope-supporting member 18, as shown particularly by FIG. 2. Where that was done, the shank of the rope-supporting member 18 would directly support only a portion of the rope 36 and would not directly support the loop 38. If desired, the small loop 38 could be held by the rope-supporting member 18 and the portion of rope 36 which passes through that small loop could rest adjacent the bottom of that small loop.

In using the boat hook provided by the present invention, a large loop 40 is provided in the rope 36; and two spaced portions of that loop will be draped on the upper sides of the shanks of the rope-supporting members 16 and 18. As shown by FIGS. 1 and 2, the large intervening portion of that loop, between those rope-supporting members, will depend downwardly from the lower sides of those shanks. As the boat approaches a piling or other mooring device, a crewman extend the boat hook 10 outwardly and forwardly toward that piling or other mooring device while holding the forward portion of that boat hook above the level of the top of that piling or other mooring device but close enough to that level to enable the lower portion of the large loop 40 to be disposed below the top of that piling or other mooring device. The movement of the boat, or the crewman, will then move the boat hook 10 horizontally toward the piling or other mooring device until the lower portion of the loop 40 engages one side of that piling or other mooring device, will continue to move the forward portion of that boat hook in that direction until the two spaced points of that loop pass over and beyond the opposite side of that piling or other mooring device, and then will rotate the boat hook in the counterclockwise direction about its axis until the shanks 26 and bent ends 30 of the rope-supporting members 16 and 18 release the two spaced portions of that loop. Thereupon, those two spaced portions, and the short length of rope 36 therebetween, will fall downwardly on the opposite side of the piling or other mooring device to completely encircle that piling or other mooring device. It will be noted that in using the boat hook of the present invention, the crewman does not have to lean outwardly beyond the side of that boat and does not have to try to cast the loop 40 over the top of the piling or other mooring device. Instead, the crewman can stand in a relaxed, erect position and use the boat hook 10 to move the loop 40 into position where it encircles the piling or other mooring device.

Where the rope-supporting members 16 and 18 are made as collars which can be readily telescoped over the inner end of a boat hook, they can be set at any desired points along the length of that boat hook. Also, they can be used with any standard and usual boat hook, and do not require a specially-machined, specially-fabricated or specially-designed boat hook. However, if desired, the rope-supporting members 16 and 18 could be permanently secured to the boat hook 10, as by being riveted, welded, or bolted to that boat hook. It should be noted that whether the rope-supporting members 16 and 18 are in the form of selectively-securable collars or are in the form of permanently-secured members, they act as portions of the boat hook.

If the rope-supporting members 16 and 18 were to be permanently attached to the boat hook 10, they could be made in different forms. For example, those rope-supporting members could be made as shanks which had the inner ends thereof directly secured to the boat hook. Bent ends are desirable, but they are not essential, for the shanks of the rope-supporting members; whether those rope-supporting members include releasably-securable collars or are permanently secured to the boat hook. Specifically, if the rope-supporting members had surfaces that were displaced outwardly from the same side of a boat hook, and if that boat hook was positioned so those surfaces extended vertically upwardly from that boat hook, two portions of the loop 40 could be disposed at one side of those surfaces, the immediately-adjacent portions of that loop could be draped over the sections of that boat hook which were immediately adjacent those surfaces, and the major portion of the loop 40 could depend downwardly in a generally-vertical plane from the opposite sides of those surfaces. To release that loop, the boat hook would be rotated about its axis until those surfaces were moved down far enough to enable those surfaces to release the two portions of loop 40.

If desired, the hook portion 14 could be used as one rope-supporting member, and a second rope-supporting member could be positioned in the area which is occupied by the rope-supporting member 18. In that event, the rope-supporting surface of the second rope-supporting member would preferably lie in, or be close to, the plane which is defined by the hook portion 14, and that surface would extend from the same side of the boat hook from which that hook portion extends. In using a boat hook equipped with such rope-supporting members, the hook portion 14 and the rope-supporting surface of the second rope-supporting member would be set close to the vertical, two spaced portions of the loop 40 would be set at the same sides of that hook portion and of that rope-supporting surface, the adjacent portions of that loop would be draped over the adjacent sections of the boat hook, and the major portion of that loop would depend downwardly in a generally-vertical plane from the opposite sides of that hook portion and of that rope-supporting surface. After the forward portion of the boat hook had been used to move the lower portion of that loop against one side of a piling or other mooring device, the forward portion of that boat hook would be used to move those two spaced portions of that loop over and beyond the other side of that piling or other mooring device, and then that boat hook would be rotated about its axis until the hook portion 14 and the rope-supporting surface of the second rope-supporting member had been moved down far enough to release the two spaced portions of the loop.

When desired, the collars 20 of the rope-supporting members 16 and 18 could be removed from the boat hook 10 for use on a different boat hook. Further, if desired, those collars could be removed from the boat hook 10 where that boat hook had to be stored in a very narrow space.

Whereas the drawing and accompanying description have shown and described a preferred embodiment of the present invention, it should be apparent to those skilled in the art that various changes may be made in the form of the invention without affecting the scope thereof.

What I claim is:

1. Boat hook having an elongated shaft and independent rope supporting members connected to the shaft in a manner enabling the distance between the supporting members to be adjusted, each rope supporting member having a shank portion that projects generally radially outwardly relative to a longitudinal axis of the shaft and an outer end portion extending from the shank portion in a direction projecting out of a plane containing said shank portion and the elongated shaft such that, with said boat hook positioned with the shank portions oriented in a generally horizontal direction and the end portions oriented in a generally vertical direction, said shank portions form a means for longitudinally and vertically supporting a looped end of a rope draped thereover from shifting relative to the elongated shaft, said outer end portions form a means for supporting the looped end of the rope from shifting longitudinally and radially of the elongated shaft, and said rope supporting members are operable to release the looped end portions solely by rotation of the elongated shaft about the longitudinal axis thereof, wherein at least one of the rope supporting members is connected to the shaft by a collar that substantially encircles the shaft and is displaceable longitudinally along the shaft for adjusting the distance between the rope supporting members.

2. A boat hook according to claim 1, wherein said collar is longitudinally displaceable along the shaft and is also fixedly secureable on the shaft.

3. A boat hook according to claim 2, wherein each rope supporting member is connected to the shaft by a respective said collar.

4. A boat hook according to claim 3, wherein each rope supporting member is generally L-shaped.

5. A boat hook according to claim 1, wherein each rope supporting member is generally L-shaped.

* * * * *